United States Patent [19]

Pahl

[11] 4,171,938

[45] Oct. 23, 1979

[54] FLUID PRESSURE OPERATED PUMP OR MOTOR

[75] Inventor: James H. Pahl, Excelsior, Minn.

[73] Assignee: Eaton Corporation, Cleveland, Ohio

[21] Appl. No.: 853,374

[22] Filed: Nov. 21, 1977

[51] Int. Cl.[2] ..... F01C 1/02

[52] U.S. Cl. ..... 418/61 B; 418/102

[58] Field of Search ..... 418/61 B, 102

[56] References Cited

U.S. PATENT DOCUMENTS

| | | | |
|---|---|---|---|
| 3,385,057 | 5/1968 | Pruvot et al. | 418/61 B X |
| 3,438,200 | 5/1969 | Jennings et al. | 418/61 B X |
| 3,532,447 | 10/1970 | Charlson | 418/61 B |
| 3,598,509 | 8/1971 | Goff et al. | 418/61 B |
| 3,601,513 | 8/1971 | White, Jr. | 418/61 B |

*Primary Examiner*—Carlton R. Croyle
*Assistant Examiner*—Leonard E. Smith
*Attorney, Agent, or Firm*—R. J. McCloskey; J. Yakimow; L. Kasper

[57] ABSTRACT

A fluid pressure operated motor is disclosed of the type utilizing a gerotor gear set and an internal output shaft and spool valve. The motor includes a housing defining a fluid inlet port and an endcap defining a fluid output port. The motor further includes a dogbone shaft defining an axial bore and having a spline connection to the output shaft at one end and a spline connection to the externally-toothed member of the gerotor at its other end. In one direction of operation of the motor, the fluid exhausted from the contracting volume chambers passes through a radial passage of the spool valve into the interior of the spool valve. A portion of this system fluid flows through the forward spline connection, then through the bore in the dogbone shaft toward the endcap, while the other portion of the system fluid flows through the rear spline connection. The two portions recombine and flow through the fluid port in the endcap. Passing substantially all of the system flow through the two spline connections greatly improves the lubrication of the splines and substantially decreases the operating temperature thereof, thereby increasing the torque capacity of the motor.

25 Claims, 8 Drawing Figures

FLUID PRESSURE OPERATED PUMP OR MOTOR

BACKGROUND OF THE DISCLOSURE

The present invention relates to rotary fluid pressure devices, and more particularly, to such devices which include an internal gear set, an input-output shaft, and a shaft member for transmitting torque therebetween.

Although it should become apparent from the subsequent description of the present invention that it may be useful with many types and configurations of rotary fluid pressure devices, including both pumps and motors, it is especially advantageous when used in a fluid motor, and will be described in connection therewith.

Also, although the invention may be used with devices having various types of internal gear sets such as those of the crescent type, the invention is especially adapted for use in a device including a gerotor gear set and will be described in connection therewith.

Furthermore, although the invention may be used in devices having various configurations of valving, such as rotating disc valves, it is especially suited for use in devices having hollow spool valves, and will be described in connection therewith.

Fluid motors of the type utilizing a gerotor gear set to convert fluid pressure into a rotary output have become popular and are especially suited for low speed, high torque applications. In most of the commercially available fluid motors of this type, one of the primary factors limiting the torque output capability of the motor is the strength of the drive connection which transmits torque from the orbiting and rotating member (rotor) of the gerotor set to the output shaft of the motor. Typically, this drive connection comprises a set of internal splines defined by the rotor, a set of internal splines defined by an enlarged portion of the output shaft, and a main drive shaft (dogbone) having a set of external splines at each end thereof in engagement with the sets of internal splines. Generally, the internal splines are straight whereas the external splines are crowned to take into account the angle at which the drive shaft is oriented relative to the axis of rotation of the motor. Therefore, although the invention may be used with devices in which the externally-toothed member of the internal gear set merely rotates about its axis, and the dogbone shaft merely rotates about its axis, the invention is especially advantageous when used in a device in which the externally-toothed member both orbits and rotates relative to the internally-toothed member, and the dogbone shaft nutates or wobbles, and the invention will be described in connection therewith.

One of the primary reasons why the spline connections have limited the torque capability of prior art motors is the heat build up which occurs as a result of the engagement between the internal and external splines. The heat build up problem is worsened in fluid motors wherein the rotor of the gerotor set both orbits and rotates and the dogbone must translate this orbital and rotational movement into pure rotational movement of the output shaft. The result is a continual rubbing movement of the external splines against the internal splines, which causes additional frictional heat.

In prior art fluid motors, the internal-external spline connections have not had sufficient lubrication. One reason is that they are frequently located in the end of a blind bore, so that any lubricating fluid which is leaked into the bore is inclined to stagnate, rather than transmit heat and contamination away from the spline connection.

The problem of insufficient lubrication of the spline connection becomes especially serious when the motor is operating at low speeds (for example, in the range of 5–10 rpm), and at high output torque (for example, 2000 in.-lbs.). Under these conditions, the temperature of the spline connection rises, the viscosity of the lubricating fluid drops, and a "break-through" of the oil film may occur, resulting in metal-to-metal contact of the splines. This, in turn, causes even more heat build up, a further decrease in torque capacity and possibly, eventual failure of the spline connection.

SUMMARY OF THE INVENTION

Accordingly, it is an object of the present invention to provide a rotary fluid pressure device of the type described which overcomes the problems of insufficient lubrication of the major torque transmitting connections.

More specifically, it is an object of the present invention to provide a fluid pressure operated pump or motor in which the main torque transmitting connections are lubricated by fluid which is part of the main system flow.

The above and other objects of the present invention are accomplished by the provision of an improved rotary fluid pressure device comprising a housing including a main housing portion defining a first fluid port and a cover housing portion defining a second fluid port. An internal gear set is disposed within the housing and includes an internally-toothed member and an externally-toothed member eccentrically disposed for relative movement. The teeth of the members interengage to define expanding and contracting volume chambers during the relative movement. The externally-toothed member defines a central, axial opening in fluid communication with the second fluid port. An input-output shaft is oppositely disposed from the cover housing portion and extends from the main housing portion and is rotatably supported thereby. Valve means is disposed within the housing and cooperates therewith to define first fluid passage means providing fluid communication between the first fluid port in one of the expanding and contracting volume chambers and second fluid passage means providing fluid communication between the other of the expanding and contracting volume chambers and an internal chamber defined by either the main housing portion or the valve means. The internal chamber is in fluid communication with the second fluid port. A shaft member has a first end portion cooperating with the input-output shaft to define a first connection means and a second end portion cooperating with the externally-toothed member to define a second connection means for transmitting torque between the toothed member and the input-output shaft. The shaft member defines a generally axial bore extending from the first end portion to the second end portion and providing fluid communication therebetween. In one direction of operation of the device substantially all of the fluid from the contracting volume chambers flows through the second fluid passage means into the internal chamber. A first portion of the fluid flows through the first connection means and through the axial bore of the shaft member toward the second fluid port. A second portion of the fluid flows through the second connection means, recombining with the first portion adjacent the second end portion and flowing out of the second fluid port.

DESCRIPTION OF THE PREFERRED EMBODIMENTS

Figure 1:
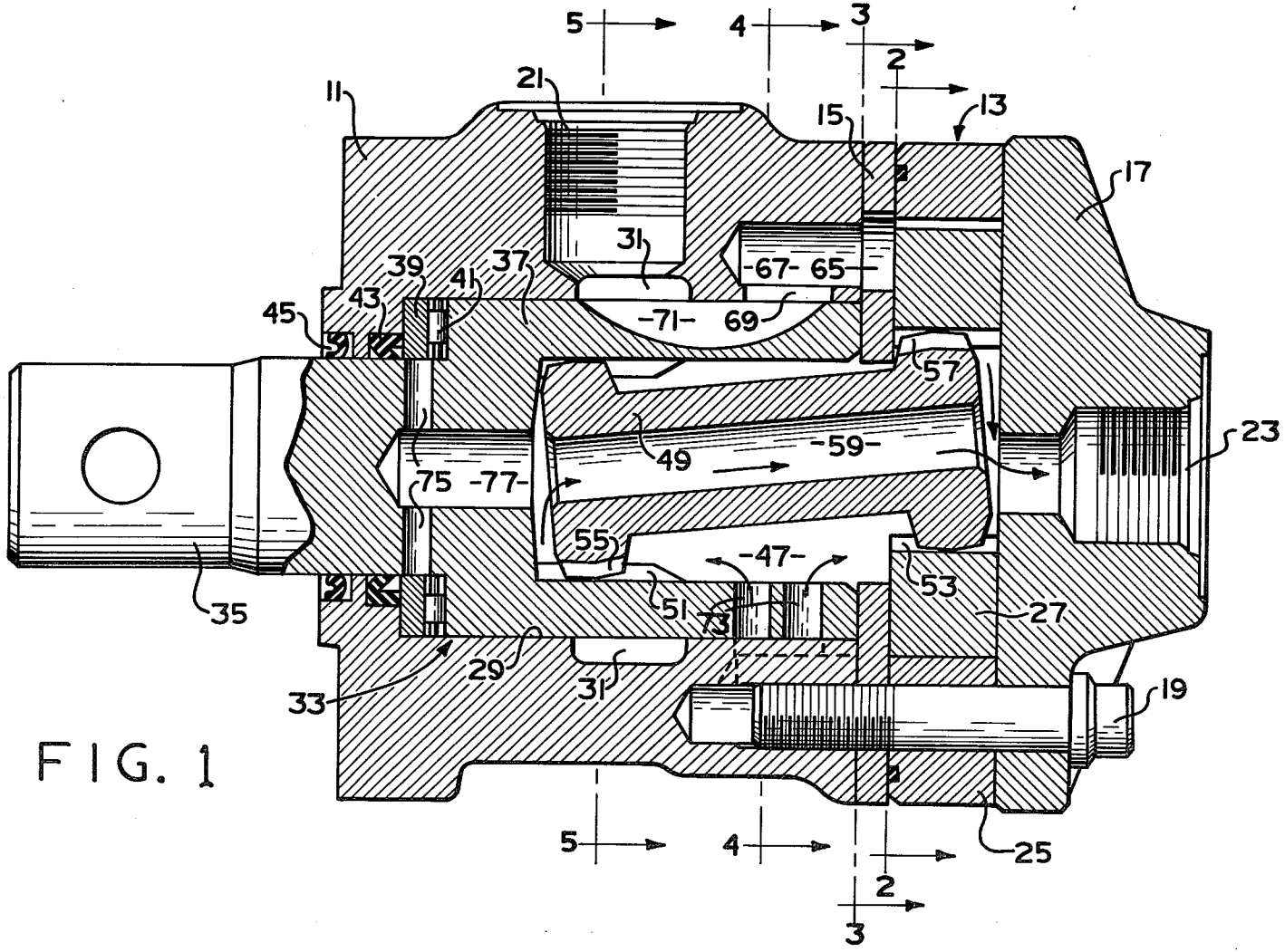
FIG. 1 is an axial cross section of a fluid motor utilizing the present invention.
Figure 2:
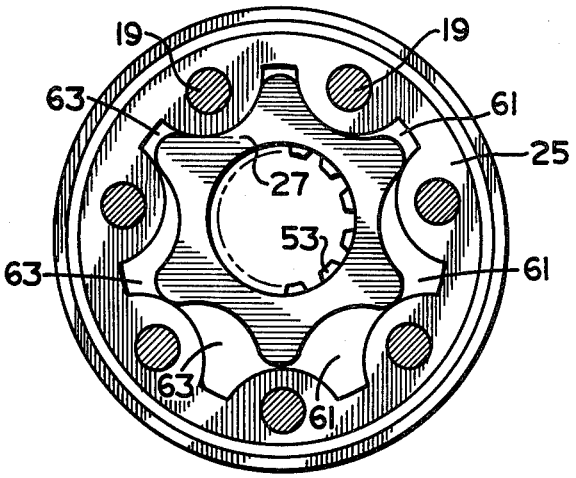
FIGS. 2, 3, 4, and 5 are transverse cross sections, taken on lines 2—2, 3—3, 4—4, and 5—5, respectively, of FIG. 1 but on a somewhat smaller scale.
Figure 3:
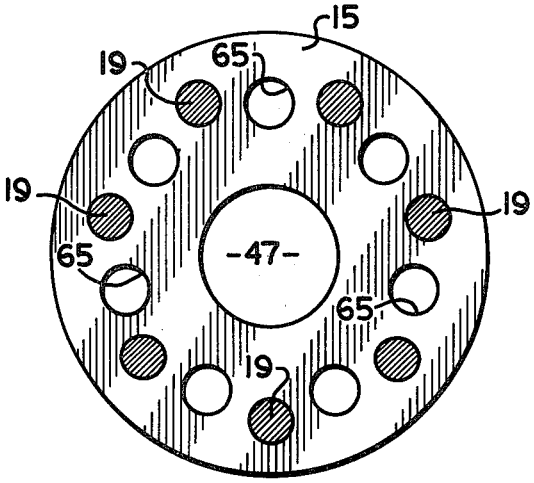
Figure 4:
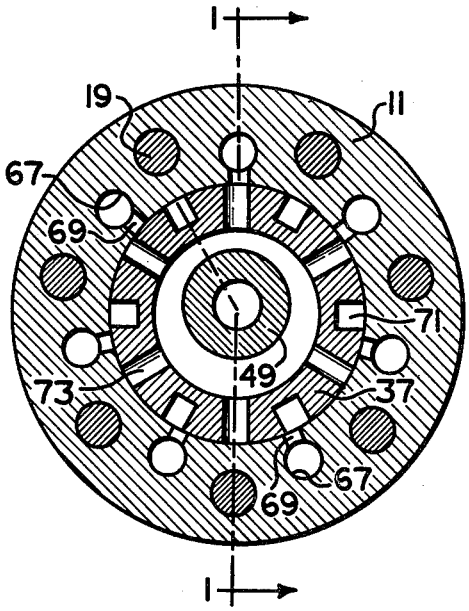
Figure 5:
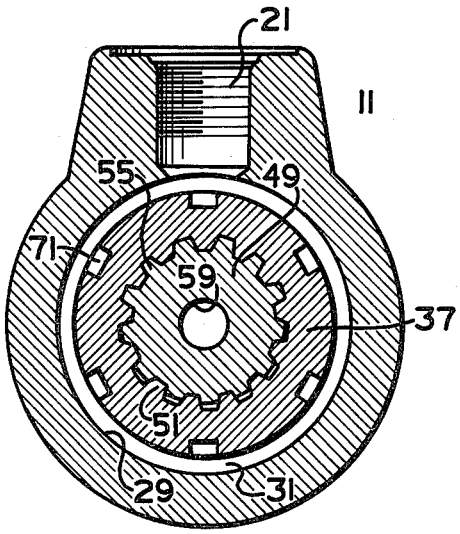

Referring now to the drawings, which are not intended to limit the invention, FIG. 1 is an axial cross section of a fluid motor of the type to which the present invention may be applied and which is described in greater detail in U.S. Pat. No. 3,606,598, assigned to the assignee of the present invention.

The fluid motor of FIG. 1 is generally cylindrical and comprises several distinct sections. The fluid motor comprises a valve housing 11, a displacement mechanism or gerotor gear set 13, and a port plate 15 disposed between the housing 11 and gerotor 13. Disposed adjacent the gerotor 13 is an endcap 17, and the housing 11, port plate 15, gerotor 13, and endcap 17 are held together in fluid sealing engagement by a plurality of bolts 19.

The valve housing 11 includes a fluid port 21 and the endcap 17 includes a fluid port 23. The gerotor gear set 13 includes an internally-toothed member 25 (stator), through which the bolts 19 pass, and an externally-toothed member 27 (rotor).

The valve housing 11 defines a spool bore 29 and an annular fluid feed groove 31 in continuous fluid communication with the fluid port 21. Disposed within the spool bore 29 is an input-output shaft assembly, generally designated 33, including a shaft portion 35 and a spool valve portion 37. Seated between the housing 11 and a forward surface (shoulder) of the spool valve portion 37 is a thrust race 39 and a thrust bearing 41. Disposed between the housing 11 and the shaft portion 35 is a pressure seal 43 and a dust seal 45.

The spool valve portion 37, the port plate 15, and the rotor 27 cooperate to define an internal chamber 47 within which is disposed a main drive shaft 49, commonly referred to as a "dogbone shaft". The input-output shaft assembly 33 defines a set of straight internal splines 51 and the rotor 27 defines a set of straight internal splines 53. The main drive shaft 49 includes a set of external crowned splines 55 in engagement with the straight splines 51 and a set of external crowned splines 57 in engagement with the internal splines 53. The main drive shaft 49 further includes an axial bore 59, the function of which will be described subsequently.

Referring now to FIGS. 2 through 5, in conjunction with FIG. 1, the structure associated with the path of the fluid flowing through the motor will be described in greater detail. Assuming clockwise rotation (counterclockwise orbiting) of the rotor 27 in FIG. 2, the teeth of the stator 25 and rotor 27 interengage to define a plurality of expanding volume chambers 61, and a plurality of contracting volume chambers 63, as is well known in the art. In fluid communication with each of the volume chambers 61,63 is a port 65 defined by the port plate 15, and in fluid communication with each of the ports 65 is an axial passage 67 (FIG. 4), drilled in the valve housing 11. Each of the axial passages 67 communicates with the spool bore 29 through a slot 69 which, typically, is milled during the machining of the housing 11.

At any given point in time, a particular passage 67 and slot 69 may be in fluid communication with the annular groove 31 and fluid port 21, or may be in fluid communication with the internal chamber 47, or may be blocked from fluid communication by the surface of the spool valve portion 37. As may best be seen in FIG. 1, the spool valve portion 37 defines a plurality of curved, axial slots 71, each of which is positioned to provide fluid communication between the annular groove 31 and one of the slots 69. The spool valve portion 37 also defines a plurality of radial passages 73, positioned to communicate between the internal chamber 47 and one of the slots 69. In the preferred embodiment, a pair of drilled passages 73 is utilized, rather than a single larger drilled hole, or a single elongated milled passage. In general, the type of "commutating" valve structure described previously is known to those skilled in the art and, it is believed, needs no further description for purposes of the present invention. It should be noted in comparing FIGS. 4 and 5 that the rotational position of the spool valve portion 37 differs by about 30 degrees in those views, and that, for ease of illustration, the cross section of FIG. 1 is not taken on a vertical plane but rather, on lines 1—1 of FIG. 4.

Referring again to FIG. 1, lubrication of the forward thrust bearing 41 is accomplished by means of a diametral clearance between the spool bore 29 and the spool valve portion 37. Assuming that the fluid port 21 is the high pressure inlet port, a small amount of fluid flows from the annular groove 31 through the diametral clearance to the thrust bearing 41. By way of example only, in the subject embodiment the diametral clearance is in the range of about 0.0007 inches to about 0.0017 inches. After lubricating the thrust bearing 41, this fluid enters a radial passage 75, from which it flows through an axial passage 77 into the internal chamber 47. It should be noted that for purposes of the present invention, the small amount of fluid which lubricates the thrust bearing 41 is not considered a part of the "full system flow" which basically refers to that portion of the fluid entering the motor which passes through the valving and the gerotor.

In describing the operation of the present invention, and specifically of the embodiment shown in FIG. 1, it will be assumed that the fluid port 21 is connected to a pressurized source of fluid, and that the fluid port 23 is connected to a fluid return line. Pressurized fluid enters through the fluid port 21 and fills the annular groove 31, and also fills each of the axial slots 71. Fluid flows from each axial slot 71 (which is in communication with a slot 69) through the respective slot 69 and into the associated axial passage 67. Pressurized fluid in several of the adjacent axial passages 67 flows through the aligned ports 65 into the expanding volume chambers 61, and at the same time, fluid flows out of each of the contracting volume chambers 63, through the adjacent ports 65 and into the aligned axial passages 67. Therefore, the axial passages 67 on one side of the line of eccentricity contain pressurized fluid, while the axial passages 67 on the other side of the line of eccentricity contain low pressure, return fluid.

The return fluid in certain of the axial passages 67 flows through the associated slots 69, then through the associated pair of radial passages 73 into the internal chamber 47. Referring now primarily to FIG. 1, a portion of the return fluid entering the internal chamber 47 flows toward one end of the shaft 49, while another portion of the return fluid flows toward the other end of the shaft 49. The first portion flows through the connection between the internal splines 51 and external splines 55, then over the forward end of the shaft 49 (the end toward the shaft portion 35), and into the bore 59 (arrows). The fluid entering the bore 59 flows toward the rearward end of the shaft 49 (the end adjacent the fluid port 23). At the same time, the second portion of the fluid entering the internal chamber 47 flows through the connection between the internal splines 53 and the external splines 57, then over the rearward end of the shaft 49, after which it recombines with the fluid flowing out of the bore 59, and is discharged from the motor through the fluid port 23.

Thus, it may be seen from the foregoing that substantially the entire system flow passing through the motor flows through the forward and rearward spline connections which are the major torque transmitting connections in the motor. Utilizing the present invention, each of the spline connections is continually lubricated by a portion of the main system flow passing through the splines and carrying away heat, as well as metal particles and other forms of contamination. A more specific advantage of the present invention is that as the speed of the motor increases, and the frictional heat generated by the splines increases, the fluid flow through the motor, and therefore the flow of lubricant through the splines, increases proportionately. In other words, by use of the invention, the normally harmful effects of increased motor speed are self-compensating.

In utilizing the present invention, it is believed to be within the knowledge of those skilled in the art to modify either the external splines, or the internal splines, or both, in order to provide sufficient flow area through each of the spline connections. It is important to be sure that neither of the spline connections provide so much of a restriction to the flow of fluid therethrough as to generate a back pressure within the motor (i.e., within the contracting volume chambers 63) which would reduce the speed of the motor. In the subject embodiment, the configuration and dimensions of the internal splines 51 and 53 are substantially identical, and similarly, the configuration and dimensions of the external splines 55 and 57 are substantially identical. As a result, the forward spline connection and the rearward spline connection provide substantially the same restriction to the flow of fluid, and because the pressure drop across each spline connection is substantially the same, the flow rate through each of the spline connections is substantially the same. In some situations, it may be desirable to provide for a higher flow rate through one of the connections than through the other, and it is believed to be within the knowledge of those skilled in the art to vary the relative flow rate through the forward and rearward connections, subsequent to a reading and understanding of the present specification.

Figure 7:
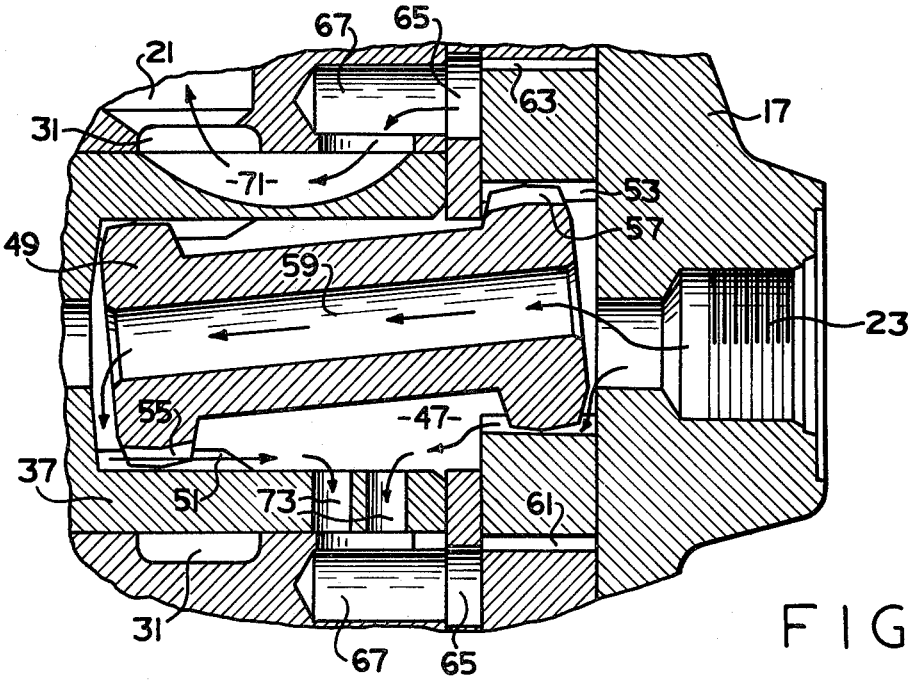
FIG. 7 is a fragmentary cross section similar to FIG. 1, but operating with a reverse direction of fluid flow.

Referring now to FIG. 7, there is illustrated the operation of the present invention with the direction of fluid flow reversed. As shown in FIG. 7, the fluid port 23 is connected to a pressurized source of fluid, with the fluid port 21 being connected to a fluid return line. As pressurized fluid flows through the fluid port 23 toward the internal chamber 47, a first portion of the full system flow enters the axial bore 59 and flows in a forward direction (arrows). As this first portion of fluid leaves the axial bore 59, it flows radially over the forward end of the shaft 49, then through the connection between the internal splines 51 and external splines 55, then toward the radial passages 73. At the same time, a second portion of the full system flow passes through the connection between the internal splines 53 and the external splines 57, then toward the radial passages 73, where the second portion recombines with the first portion and substantially all of the system fluid flows through radial passages 73, through the adjacent slots 69, the axial passages 67, the ports 65 and into the expanding volume chambers 61.

At the same time, fluid flows out of each of the contracting volume chambers 63, through the adjacent ports 65 and into the aligned axial passages 67. This return fluid in certain of the axial passages 67 flows through the associated slots 69, then through the aligned axial slots 71, from where all of the return fluid enters the annular groove 31, then flows out of the fluid port 21 to the return line.

By way of comparing the two different directions of operation illustrated by FIGS. 1 and 7, it should be noted that in FIG. 1 pressurized fluid enters the motor, flows through the gerotor to exert a driving torque on the rotor, then low pressure fluid exhausted from the gerotor flows through the spline connections and out of the motor. In FIG. 7, however, pressurized fluid enters the motor, flows through the spline connections, then through the gerotor, with the low pressure fluid exhausted from the gerotor flowing out of the motor. Therefore, in one direction of operation, the splines are lubricated by low pressure return fluid, while in the other direction, the splines are lubricated by high pressure inlet fluid, but in either direction, the quantity of fluid flow through the splines in the same. Although both directions of operation of the present invention have been illustrated and described in the present specification, it should be noted that, as recited in the appended claims, the use of the invention in only one direction is considered to constitute practicing the invention.

Figure 6:
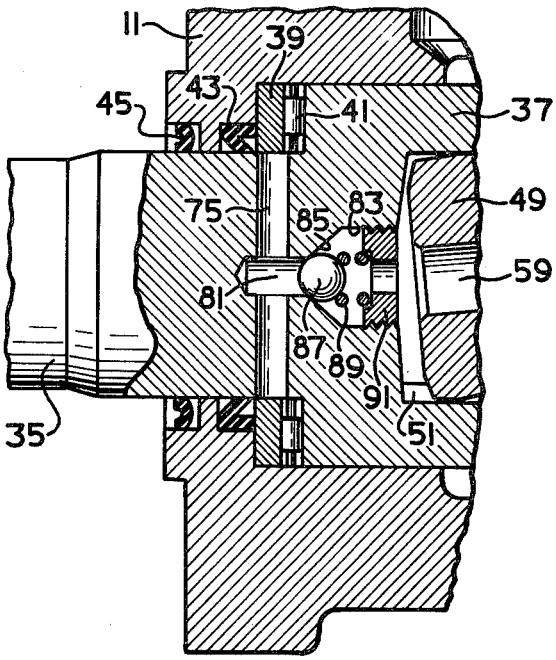
FIG. 6 is a fragmentary cross section, similar to FIG. 1, illustrating an alternative embodiment of the fluid motor of FIG. 1.

Referring now to FIG. 6, there is illustrated an alternative embodiment, not of the invention, but of the associated structure contained in the fluid motor of FIG. 1. It is considered desirable to utilize the structure of FIG. 6 whenever the fluid motor is operated in the direction illustrated in FIG. 7, wherein the internal chamber 47 is subjected to pressurized inlet fluid. In the embodiment of FIG. 6, the axial passage 77 of FIG. 1 is replaced by a smaller axial passage 81 and a larger axial passage 83, a portion of which is internally threaded. The passages 81 and 83 are joined by a conical surface 85 which intersects passage 81 and provides a seat for a ball valve 87. The ball valve 87 is held against the seat by means of a compression spring 89, the forward end of which is seated against the ball, and the rearward end of which is seated against a threaded, adjustment member 91, by means of which the preload on the ball valve 87 may be varied. The purpose of the arrangement shown in FIG. 6 is to permit a small leakage of lubricating fluid to pass through the radial passages 75 to the thrust bearing 41, without subjecting the pressure seal 43 to the full system pressure present in the internal chamber 47.

Figure 8:
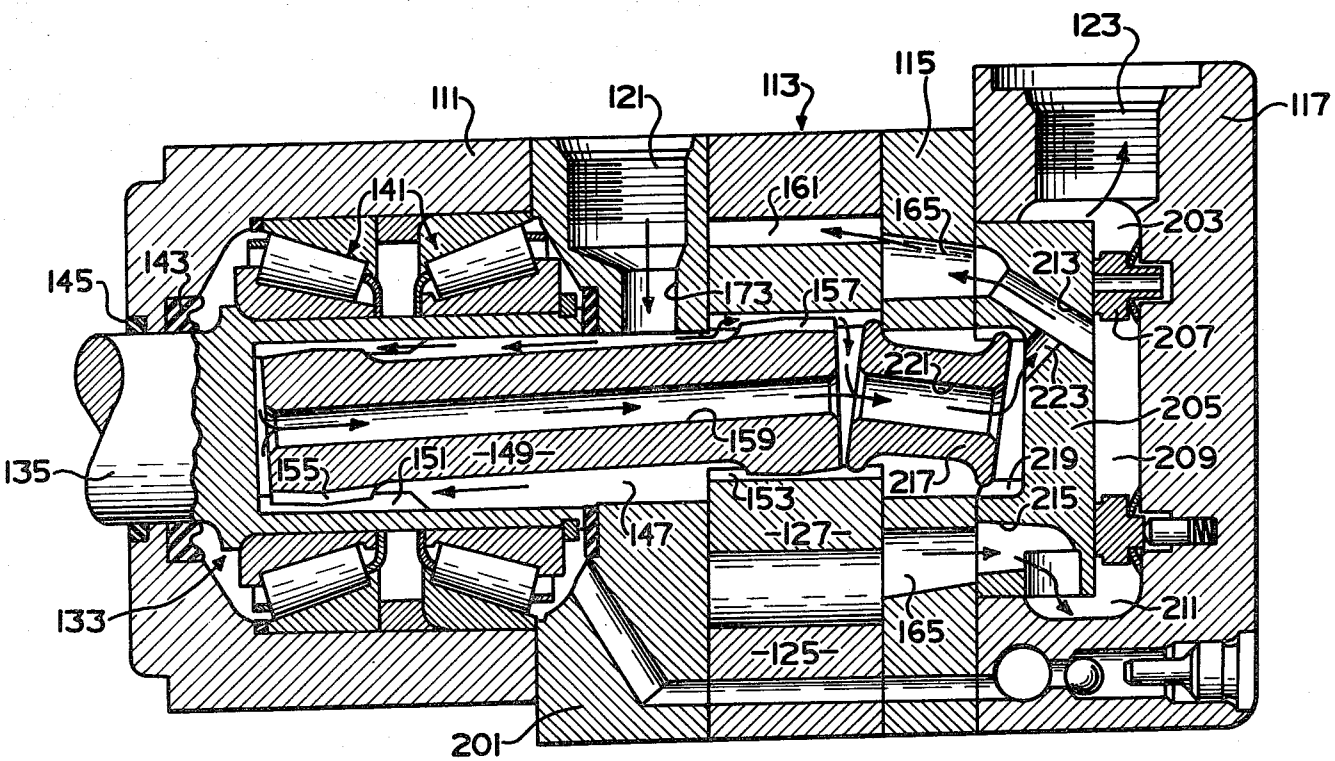
FIG. 8 is an axial cross section of a fluid motor of the disc valve type, utilizing the present invention.

Referring now to FIG. 8, there is shown an axial cross section of a fluid motor of the "disc valve" type, utilizing the present invention. The general type of motor shown in FIG. 8 is illustrated and described in greater detail in U.S. Pat. Nos. 3,572,983 and 3,862,814, assigned to the assignee of the present invention. For purposes of brevity, and to facilitate an understanding of the concept as applied to a disc motor, elements of the motor shown in FIG. 8 which are generally analagous to elements in FIG. 1 bear the same reference numeral, plus 100. For those elements in FIG. 8 which are not analagous to any shown previously, reference numerals above 200 are used.

The fluid motor comprises a plurality of sections secured together, as by a plurality of bolts (not shown) and including a housing 111, a gerotor gear set 113, a port plate 115, and an endcap 117. Disposed between the housing 111 and the gerotor set 113 is a wear plate 201 which defines a fluid port 121, and the endcap 117 defines a fluid port 123.

The motor includes an input-output shaft assembly 133 including a hollow, annular portion positioned within housing 111 and rotatably supported therein by suitable bearing sets 141. A shaft portion 135 projects forwardly out of the housing 111. The hollow portion of the shaft assembly 133, the wear plate 201, the externally-toothed rotor 127 and the port plate 115 cooperate to define an internal fluid chamber 147 within which is disposed a main drive shaft 149. The hollow portion of the shaft assembly 133 defines a set of straight internal splines 151 and the rotor 127 defines a set of straight internal splines 153. The main drive shaft 149 includes a set of external crowned splines 155 in engagement with the straight splines 151 and a set of external crowned splines 157 in engagement with the internal splines 153. The main drive shaft 149 further includes an axial bore 159, which communicates only between the opposite ends of the shaft 149. The fluid port 121 communicates with the internal chamber 147 through a radial passage 173.

The endcap 117 defines an annular fluid chamber 203 in fluid communication with the fluid port 123. Disposed within the chamber 203 is an annular, rotatable disc valve 205 of the type well known in the art and described in the above-cited patents, which are incorporated herein by reference. Disposed in sealing engagement against the surface of the disc valve 205 is a pressure balancing ring 207 which, together with the disc valve 205, separates the fluid chamber 203 into an inner, circular chamber 209 and an outer, annular chamber 211. The disc valve 205 defines a plurality of angled passages 213 communicating between the chamber 209 and certain of the fluid ports 165. The disc valve 205 further defines a plurality of passages 215 communicating between the chamber 211 and other of the fluid ports 165.

It should become apparent to those skilled in the art, from a reading of the specification, that the present invention may be utilized in disc valve motors of various types and configurations. For example, the disc valve could be annular and disposed between the housing 111 and the gerotor gear set 113. Also, within the scope of the invention, the disc valve 205, whether ahead of or behind the gerotor, could operate as a "high speed" valve or "low speed" valve. When serving as a high speed valve, the disc valve rotates at the orbiting speed of the rotor 127, whereas, when serving as a low speed valve, the disc valve rotates at the rotational speed of the rotor 127. In the subject embodiment, the disc valve 205 is driven as a low speed valve by means of a valve drive shaft 217 having a set of external splines engaging the internal splines 153, and another set of external splines engaging internal splines 219 defined by the disc valve 205. The valve drive shaft 217 defines an axial bore 221 which should be capable of passing substantially full system flow therethrough, as will be described subsequently.

In describing the operation of the embodiment of FIG. 8, it will be assumed that the fluid port 121 is connected to a pressurized source of fluid, and that the fluid port 123 is connected to a fluid return line. Pressurized fluid enters through the fluid port 121, then flows through radial passage 173 into the internal chamber 147. A first portion of this system fluid flows through the connection between internal splines 151 and external splines 155, over the forward end of the drive shaft 149 and into the axial bore 159. A second portion of the system fluid flows through the connection between the internal splines 153 and the external splines 157, then over the rearward surface of the drive shaft 149, where it recombines with the first portion as it flows rearwardly out of the axial bore 159. Most of the system flow then passes through the axial bore 221 in the valve drive shaft 217, after which it passes through a plurality of angled passages 223, through the angled passages 213, through the fluid pots 165 and into the expanding volume chambers 161. At the same time, low pressure fluid is exhausted from the contracting chambers (not shown) and flows through the adjacent fluid ports 165, through the passages 215 into the annular chamber 211, and out through the fluid port 123 to the return line. Therefore, for the direction of flow just described, the spline connections are lubricated by high pressure inlet fluid before it flows through the valving and the gerotor, whereas if the fluid motor of FIG. 8 were operated in the reverse direction, pressurized fluid would flow through the valving and the gerotor, with the low pressure exhausted from the gerotor flowing through the spline connections, then out of the motor. However, as was mentioned in regard to the prior embodiment, the important aspect of the invention is not the pressure of the fluid which lubricates the splines but rather, the flow rate through the splines achieved by using substantially full system flow for lubrication.

I claim:

1. A rotary fluid pressure device comprising:

(a) housing means including a main housing portion defining a first fluid port and a cover housing portion defining a second fluid port;

(b) an internal gear set disposed within said housing means and including an internally-toothed member and an externally-toothed member eccentrically disposed within said internally-toothed member for relative movement therein, the teeth of said members interengaging to define expanding and contracting volume chambers during said relative movement;

(c) said externally-toothed member defining a generally central, axially-extending opening in fluid communication with said second fluid port;

(d) input-output shaft means oppositely disposed from said cover housing portion, extending from said main housing portion, and rotatably supported thereby;

(e) valve means disposed within said housing means and cooperating therewith to define first fluid passage means providing fluid communication between said first fluid port and one of said expanding and contracting volume chambers and second fluid passage means providing fluid communication between the other of said expanding and contracting volume chambers and an internal chamber defined by one of said main housing portion and said valve means, said internal chamber being in fluid communication with said second fluid port;

(f) a shaft member having a first end portion cooperating with said input-output shaft means to define a first connection means and a second end portion cooperating with said externally-toothed member to define a second connection means to transmit torque between said externally-toothed member and said input-output shaft means;

(g) said shaft member defining a generally axial bore extending from said first end portion to said second end portion and providing fluid communication therebetween;

(h) in one direction of operation of said device, substantially all fluid exhausted from said contracting volume chamber flowing through said second fluid passage means into said internal chamber, a first portion thereof flowing through said first connecton means, and through said axial bore of said shaft member toward said second fluid port, a second portion thereof flowing through said second connection means, recombining with said first portion adjacent said second end portion and flowing out of said second fluid port.

2. A rotary fluid pressure device consisting essentially of:

(a) a housing defining a fluid inlet port for receiving full system flow and an axial spool bore;

(b) a cover member defining a fluid outlet port;

(c) a gerotor gear set disposed between said housing and said cover member and including an internally-toothed stator and an externally toothed rotor eccentrically disposed within said stator for orbital and rotational movement therein, the teeth of said stator and rotor interengaging to define a plurality of expanding and contracting volume chambers during said movement, said externally toothed rotor defining a central opening in fluid communication with said fluid outlet port;

(d) a port plate disposed between said housing and said gerotor gear set and defining a plurality of ports, each of said ports being disposed for fluid communication with one of said expanding and contracting volume chambers;

(e) a valve and shaft member including a spool valve portion rotatably disposed within said spool bore and an output shaft portion partially disposed within said housing, said spool valve portion defining an axially-oriented bore, and sealing and bearing means disposed radially between said output shaft portion and said spool bore;

(f) a shaft member having a first and second end portions and first and second end surfaces, said first end portion being disposed within said axial bore of said spool valve portion and cooperating therewith to form a first spline connection, said second end portion being disposed within said central opening of said rotor and cooperating therewith to form a second spline connection to transmit torque between said rotor and said valve and shaft member, said shaft member defining a bore extending between said first and second end surfaces and permitting fluid communication only therebetween;

(g) said housing and said spool valve portion cooperating to define a plurality of inlet passages communicating between said fluid inlet port and said expanding volume chambers, and a plurality of exhaust passages communicating between said contracting volume chambers and said axial bore of said spool valve portion, each of said exhaust passages including a generally radial opening through said spool valve portion intermediate said first and second spline connections; and (h) substantially all of said system flow exhausted from said contracting volume chambers flowing through said exhaust passages into said axial bore, one portion of said system flow flowing through said second spline connection, substantially the remainder of said system flow flowing through said first spline connection and through said bore of said shaft member, said one portion and said remainder of said system flow recombining and flowing out said fluid outlet port.

3. A rotary fluid pressure device comprising:

(a) housing means including a main housing portion defining a first fluid port and a cover housing portion defining a second fluid port;

(b) an internal gear set disposed within said housing means and including an internally-toothed member and an externally-toothed member eccentrically disposed within said internally-toothed member for relative movement therein, the teeth of said members interengaging to define expanding and contracting volume chambers during said relative movement;

(c) said externally-toothed member defining a generally central, axially-extending opening capable of permitting a substantial amount of fluid therethrough;

(d) input-output shaft means oppositely disposed from said cover housing portion, extending from said main housing portion, and rotatably supported thereby;

(e) valve means disposed within said housing means and cooperating therewith to define first fluid passage means providing fluid communication between said first fluid port and one of said expanding and contracting volume chambers, and second fluid passage means providing fluid communication between the other of said expanding and contracting volume chambers and said second fluid port;

(f) an internal chamber defined by one of said main housing portion, said valve means, said central opening of said externally-toothed member and combinations thereof;

(g) a shaft member, disposed within said internal chamber, having a first end portion cooperating with said input-output shaft means to define a first connection means and a second end portion cooperating with said externally-toothed member to define a second connection means to transmit torque between said externally-toothed member and said input-output shaft means, said shaft member further defining a generally axial bore extending from said first end portion to said second end portion and providing fluid communication therebetween;

(h) one of said first and second fluid passage means including said internal chamber and communicating therewith
(1) at a first location disposed intermediate said first and second connection means and
(2) at a second location adjacent said second end portion of said shaft member;
(i) in one direction of operation of said device, system fluid flowing from said first location, a first portion thereof flowing through said first connection means, and through said axial bore of said shaft member toward said second end portion, a second portion of said system fluid flowing through said second connection means, recombining with said first portion and flowing through said second location, said first and second portions comprising substantially all of said system fluid; or
(j) in another direction of operation of said device, system fluid flowing from said second location, a first portion thereof flowing through said axial bore of said shaft member, through said first connection means and toward said first location, a second portion of said system fluid flowing through said second connection means, recombining with said first portion, and flowing through said first location, said first and second portions comprising substantially all of said system fluid.

4. A device as claimed in claim 3 wherein said first connection means defines a first flow restriction, and said second connection means defines a second flow restriction, said first and second flow restrictions being approximately equal, whereby said first and second portions of said system fluid are approximately equal.

5. A device as claimed in claim 3 wherein said second fluid passage means includes said internal chamber.

6. A device as claimed in claim 3 wherein said first fluid passage means includes said internal chamber.

7. A device as claimed in claim 3 wherein said input-output shaft means includes a hollow, annular portion rotatably supported within said main housing portion, said annular portion defining a first set of internal splines, said first end portion defining a first set of external splines, said first internal and external splines comprising said first connection means.

8. A device as claimed in claim 7 wherein said externally-toothed member defines a second set of internal splines, said second end portion defines a second set of external splines, said second internal and external splines comprising said second connection means.

9. A device as claimed in claim 3 wherein said main housing portion defines a spool bore, and said valve means includes a hollow, annular valve spool rotatably disposed within said spool bore, said valve spool and said input-output shaft means being adapted for common rotary movement.

10. A device as claimed in claim 9 wherein said input-output shaft means and said valve spool are formed integrally.

11. A device as claimed in claim 10 wherein said spool bore engaging the surface of said valve spool comprises the primary bearing means for radial loads applied to said input-output shaft means.

12. A device as claimed in claim 9 wherei said input-output shaft means and said valve spool cooperate to define a shoulder at the junction thereof, said main housing portion defining a bearing seat adjacent said shoulder, and including a bearing set disposed between said seat and said shoulder.

13. A device as claimed in claim 12 wherein said spool bore and said valve spool cooperate to define a leakage clearance communicating between said first fluid passage means and said bearing set to permit a relatively small amount of leakage fluid to lubricate said bearing set.

14. A device as claimed in claim 9 wherein said second fluid passage means includes at least one radial passage defined by said valve spool and communicating with said internal chamber, the intersection of said radial passage and said internal chamber compising said first location.

15. A device as claimed in claim 14 wherein said first fluid passage means includes at least one axially-disposed slot defined by said valve spool and being in continuous fluid communication with said first fluid port.

16. A device as claimed in claim 15 wherein said main housing portion defines one fluid passage communicating with each of said expanding and contracting volume chambers, said radial passages and said axial slots communicating commutatively with said fluid passages in response to rotation of said valve spool.

17. A device as claimed in claim 3 wherein said internal gear set comprises a gerotor gear set.

18. A device as claimed in claim 17 wherein each of said first and second connection means comprises a universal-type connection.

19. A device as claimed in claim 18 wherein each of said first and second connection means comprises a set of internal splines and a set of crowned, external splines.

20. A device as claimed in claim 17 wherein said relative movement of said toothed members comprises said externally-toothed member orbiting and rotating relative to said internally-toothed member, the teeth of said members interengaging to define a plurality of expanding volume chambers on one side of the line of eccentricity and a plurality of contracting volume chambers on the other side of the line of eccentricity during said relative movement.

21. A device as claimed in claim 20 wherein said valve means includes a rotatable disc valve operable to rotate at one of said orbiting and said rotating movements of said externally-toothed member.

22. A device as claimed in claim 21 wherein said gerotor gear set is disposed between said disc valve and said main housing portion.

23. A device as claimed in claim 22 wherein said cover housing portion defines an annular fluid chamber in fluid communication with said second fluid port, said disc valve being disposed within said annular fluid chamber.

24. A device as claimed in claim 22 including a valve drive shaft having one end engaging said externally-toothed member and the other end engaging said disc valve to translate orbiting and rotating movement of said externally-toothed member into rotating movement of said disc valve.

25. A device as claimed in claim 24 wherein said valve drive shaft defines a fluid passage capable of passing full system flow therethrough substantially unrestricted.

* * * * *